United States Patent [19]

Vidal

[11] 4,412,760

[45] Nov. 1, 1983

[54] METHOD FOR PRODUCING A STRUCTURE HAVING COHESION BY MEANS OF A MATERIAL COMPRISING NON-COHERENT SOLID PARTICLES

[76] Inventor: Henri Vidal, 8 bis Boulevard Maillot, 92200 Neuilly sur Seine, France

[21] Appl. No.: 233,458

[22] Filed: Feb. 11, 1981

[30] Foreign Application Priority Data

Feb. 13, 1980 [ZA] South Africa ..... 80/0816

[51] Int. Cl.[3] ..... E02D 27/00; E02D 29/02

[52] U.S. Cl. ..... 405/267; 405/284; 299/11

[58] Field of Search ..... 405/229, 266, 267, 272, 405/284; 299/11; 166/292, 293

[56] References Cited

U.S. PATENT DOCUMENTS

| | | | |
|---|---|---|---|
| 3,340,693 | 9/1967 | Row | 299/11 X |
| 3,376,146 | 4/1968 | Mitchell | 166/292 X |
| 3,557,876 | 1/1971 | Tragesser | 166/292 |
| 3,570,253 | 3/1971 | Vidal | 405/284 |
| 3,713,489 | 1/1973 | Fast et al. | 166/292 |
| 3,799,787 | 3/1974 | Davis | 405/267 X |
| 3,876,005 | 4/1975 | Fincher et al. | 166/292 |
| 4,059,963 | 11/1977 | Wayment | 405/267 |
| 4,309,059 | 1/1982 | Walsh | 299/11 |

FOREIGN PATENT DOCUMENTS

| | | | |
|---|---|---|---|
| 567320 | 12/1958 | Canada | 166/292 |

*Primary Examiner*—David H. Corbin
*Assistant Examiner*—Nancy J. Pistel
*Attorney, Agent, or Firm*—Burns, Doane, Swecker & Mathis

[57] ABSTRACT

There is constructed around pillars of a mine chamber on the ground a rectangular enclosure which is defined by superimposed layers of U-section elements. The concavity of the latter faces inwardly of the enclosure. A pulverulent material is poured by a hydraulic filling method into the enclosure. This pulverent material preferably comprises light fine ash having hydraulic properties. Owing to the reinforcements embedded in the mass, the structure initially behaves as stabilized earth, but, in the end, the material sets and becomes coherent so that finally the structure has a lean concrete character.

23 Claims, 2 Drawing Figures

METHOD FOR PRODUCING A STRUCTURE HAVING COHESION BY MEANS OF A MATERIAL COMPRISING NON-COHERENT SOLID PARTICLES

The present invention relates to a method for producing a structure having cohesion with the use of a material comprising essentially non-coherent solid particles, said structure having facing wall or walls cladded with a cladding whose component elements form or support reinforcements, with which reinforcements a layer of said particles is in contact.

Stabilized earth structures produced by means of such a method have been disclosed in particular in French Pat. No. 1,393,988 (U.S. Pat. No. 3,421,326), U.S. Pat. No. 3,981,038, French Pat. No. 2,315,572, U.S. Pat. No. 4,125,970, all in the name of the Applicant, the teachings of which are in part applicable to the subject matter of the present invention.

An object of the invention is to provide new procedures for carrying out the aforementioned method whereby it is possible to produce structures whose nature and function are comparable to structurs of stabilized earth.

The feature of this method is that at least a part of the material used initially comprises elements which subsequently render the material, or a fraction of the material, coherent.

The elements which at the end of a period of time create the cohesion may comprise at least partly the solid particles themselves, in which case these particles preferably have pozzolanic or hydraulic properties so that the material, or the corresponding fraction of the material, placed in position mixed with the water, i.e. in the pulverulent state, becomes coherent after a period of time. These elements may also constitute a product of addition employed alone or in combination with particles having pozzolanic or hydraulic properties, such as lime, cement, calcium chloride, which also produce in the known way a setting effect when mixed with water. The product of addition may also be any substance, possibly liquid or mixed with a liquid, which, after having been used, undergoes a physical or chemical evolution and acquires the properties of an adhesive or of a plastic or rigid binder.

If it is assumed, in accordance with a preferred arrangement, that the cladding elements are juxtaposed and superimposed U-section elements whose flanges are possibly fixed to reinforcements, preferably formed by relatively flexible bands, as the material mixed with or impregnated with water or another liquid is poured and retained within the facing wall or walls which are already in position, a part of the solid pulverulent particles come in contact with the flanges of the section elements and, as the case may be, with the reinforcements and create, by friction with the flanges and/or with the reinforcements, a cohesion the effect of which is to render the mass formed within the facing wall or walls stable and resistant. This mass indeed constitutes, either wholly or in parts thereof where the association of the solid particles and the flanges and/or the reinforcements produces cohesion, a volume of stable and resistant stabilized earth.

In any case, the presence within the pulverulent material of elements creating cohesion and possibly water or other liquid, results, at the end of a more or less long period of time, in a phenomenon of setting or adhesion which renders the initially pulverulent material coherent, the effect of which is to transform the whole of the mass into a kind of lean concrete reinforced by the flanges of the U-section elements and, as the case may be, the reinforcements.

The mass consequently behaves at least partly in the manner of a stabilized earth structure during the first stage of its evolution which immediately follows on its construction, and a structure of lean concrete in the second stage corresponding to the phenomenon of the setting or adhesion of the solid particles.

The solid particles may have any origin, for example, they may be extracted from the natural ground.

If the particles have pozzolanic or hydraulic properties, they may be taken from volcanic ash, such as pozzolana, or tuffs, or trass. Most often, the particles having the pozzolanic or hydraulic properties will come from industrial by-products such as light fine ash from power stations producing electricity and blast furnace slag which is usually in the form of granules.

As concerns the products of addition having the function of an adhesive, they may be employed in the form of a solution, suspension, emulsion, etc.

The method according to the invention permits the construction of structures which, in their final state, are more rigid than stabilized earth structures which have in principle a certain flexibility.

Another advantage of the proposed method is to render useful products which are available in the vicinity of the site where the structure must be constructed and which sometimes encumber the region and are even pollutant as in the case of light fine ash.

Further, in the event that the solid particles such as ash or cohesion creating products of addition do not comprise aggressive elements, the cohesion of the mass due to the setting phenomenon may result in economy as concerns the reinforcements in that these reinforcements, in the same way as reinforcements employed for reinforced concrete, may be of a material which is not particularly resistant to corrosion and is consequently cheaper than that of reinforcements normally incorporated in stabilized earth structures.

The pulverulent material may be placed in position in the dry state behind the facing wall or walls, and be subsequently sprayed with water, but it is also possible to form the mixture of pulverulent material and water beforehand and to place the material in position, for example by the effect of gravity or by means of pumps, by hydraulic filling in in accordance with the technique currently employed in mine working for filling hollows.

This hydraulic filling in technique may be in fact carried out in accordance with the invention in a mine and in particular a coal mine chamber for the purpose of consolidating the "pillars" which remain after the coal or other mineral has been extracted, the function of which is to support the pressure exerted by the superjacent ground. It is indeed possible to carry out the method according to the invention by constructing on the ground of the chamber around a group of pillars an enclosure of closed contour, for example rectangular contour, whose walls are obtained by the horizontal juxtaposition and super-imposition of U-section elements the concavity of which faces inwardly and the flanges of which form reinforcements, or support reinforcements in the form of a relatively flexible band, and to effect within the enclosure a hydraulic filling in by means of a material whose solid particles are advantageously mainly formed by ash, i.e. a by-product which is widely available in a site near to a coal mine where a power station is installed.

The resistant enclosure which surrounds the pillars to a great height, without necessarily reaching the hanging wall of the chamber, thus provides around the pillars a binding which partly re-establishes the lateral retention that the excavation of the chambers had eliminated. Consequently, the tendency to swell under compressive load which might occur in the centre zone of the pillars is completely eliminated.

The invention will be explained merely by way of example in the ensuing description of a manner of carrying out the method according to the invention with reference to the accompanying drawing in which.

Figure 1:
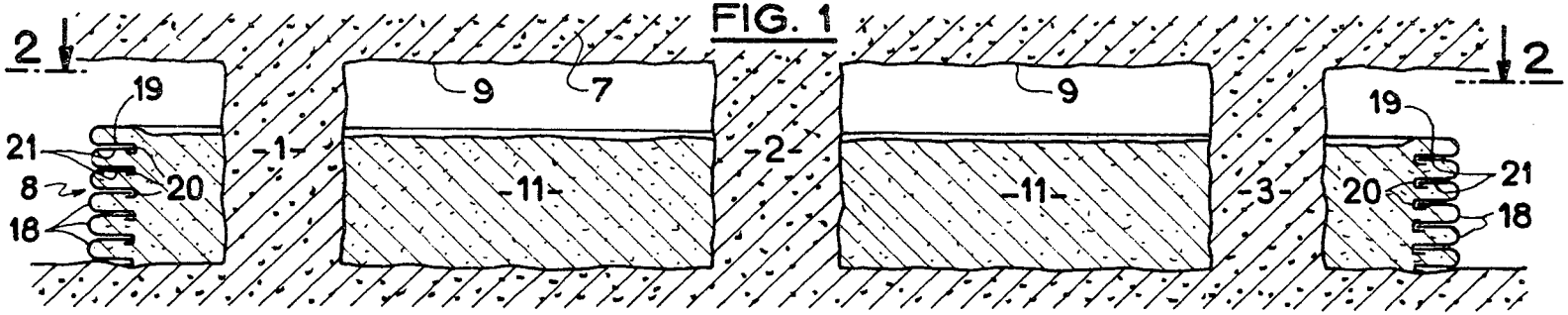
FIG. 1 is a vertical sectional view of pillars of a mine which have been consolidated by means of a fill contained within an enclosure.
Figure 2:
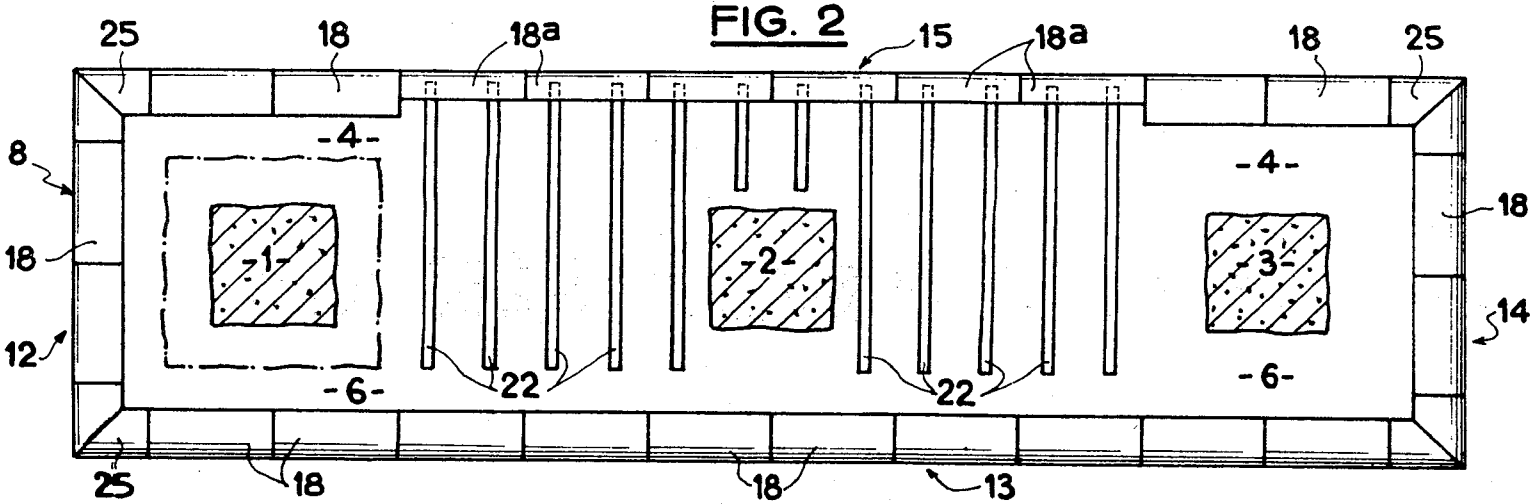
FIG. 2 is a sectional view taken on line 2—2 of FIG. 1.

FIGS. 1 and 2 show a part of a coal mine working area from which the coal has been extracted by the bord-and-pillar method. The aligned pillars 1 to 3 defining two chambers 4, 6 of a height which is assumed to be constant, take the whole of the pressure of the earth 7 above the abandond working area.

In order to avoid the risk of the pillars compressed in this way undergoing a swelling over a long period which might result in their collapse, and also in order to improve the yield of the working of the mine by a reduction in the section of the pillars, the latter are surrounded by a rectangular enclosure 8 which is filled up to a level distinctly above the middle of the pillars, without however reaching the hanging wall 9 of the chambers, with a hydraulic fill material 11.

The four walls 12 to 15 of the enclosure 8 are formed by the superimposition of a number of layers of metal U-section elements 18, 18*a*, which are disposed roughly in adjoining relation in each layer and whose lower flange 19 has a free edge portion shaped as a hook 20 as to engage with the smooth edge of the upper flange 21 of one or more subjacent U-section elements.

Reference 25 designates right-angled elbow shaped connections provided in each layer at the four corners of the enclosure 8 for interconnecting the section elements of two adjacent perpendicular walls.

The section elements 18 of which the end walls 12, 14, one of the side walls 13 and the end parts of the other side wall 15 are formed, are section elements having large flanges, whereas the section elements 18*a* constituting the side wall 15 on the major part of its length between the end parts, are section elements whose flanges are relatively small or narrow. The section elements 18*a* are however completed by reinforcements 22 formed by relatively flexible bands of metal which are each connected at one of their ends, by bolting, through two flanges 19, 21 which are in mutual contact therewith and pertain to superimposed section elements, these bands being embedded in the fill 11 and their other end being free of any attachment. This arrangement is conventional in stabilized earth structures as is clear from French Pat. No. 1 393 988 and U.S. Pat. No. 3,421,326.

These patents also mention the possibility of making the flanges of the U-section elements perform the function of a reinforcement of a stabilized earth structure, as is the case of the section elements 18 having large flanges of the present application.

The fill 11, supplied by a hydraulic filling inside the enclosure 8 defined by the walls 12 to 15, is a mixture comprising essentially water and pulverulent ash. The solid particles of ash which, as the fill rises, come into frictional contact with the flanges of the section elements 18, 18*a* and with the reinforcements 22, impart a cohesion to the mass formed within the enclosure which, according to the teaching of the aforementioned patents, has the characteristics of a stable and strong stabilized earth construction.

The choise of ash as a constituent of the fill is justified by the fact that light fine ash is usually available in the vicinity of coal mines as the by-product of power stations and by the property that this ash has, when mixed with water, of setting at the end of a relatively long period of time so that, in the long run, the fill which initially formed stabilized earth is transformed into a kind of very lean concrete reinforced in the manner of reinforced concrete by the presence of the flanges of the section elements 18, 18*a* and the reinforcements 22.

Consequently, irrespective of the age of the mass enclosed within the enclosure 8, the pillars 1 to 3 trapped therein up to a great height benefit from a binding effect or lateral retenion which enables them to resist indefinitely the pressures exerted thereon by the superjacent ground 7.

Although there has been described the combined use of section elements having large flanges 18 and flexible bands 22 attached to the section element 18*a* in order to constitute the reinforcements of a volume of stabilized earth, it will be understood that an enclosure such as 8 could be constructed with walls exclusively formed by means of section elements 18 having large flanges or with walls exclusively formed by means of section elements 18*a* having short flanges to which reinforcements 22 in the form of a band may be fixed.

By forming the side walls 13, 15 exclusively by means of section elements 18 having large flanges, these section elements would define, in combination with the solid particles filling their cavities, a thick wall of stabilized earth whose stability would be sufficient to resist the thrust exerted by the known reinforced material contained between the two walls 13, 15.

In the described embodiment, the walls 12 to 15 of the enclosure and the fill 11 remain at a level lower than the hanging wall 9. However, it is possible to employ the invention by producing a hydraulic fill which reaches the level of the hanging wall and, if desired, by also raising all or part of the walls up to the level of the hanging wall 9.

It should be stressed that the foregoing description with reference to the Figures, only concerns one example of one of the many possible applications of the method according to the invention.

Having now described my invention what I claim as new and desire to secure by Letters Patent is:

1. A method for consolidating at least one pillar of ground against collapse, said method comprising the steps of constructing around and in spaced relation to said at least one pillar a continuous wall of superimposed cladding elements having integral reinforcing means extending from said cladding elements toward said at least one pillar in a plurality of substantially horizontal vertically spaced-apart planes, filling the space between said wall and said at least one pillar with material including substantially non-coherent solid particles to frictionally contact said reinforcing means and constitute a frictionally stabilized structure that immediately protects said at least one pillar, said material including additional means which when mixed with said particles cause said material to set and become a cohesive structure, the time required for the setting of said material and the quality of said particles and said additional means of said material are not critical for the desired consolidation of said at least one pillar.

2. A method according to claim 1, wherein the material comprises solid particles having pozzolanic or hydraulic properties.

3. A method according to claim 2, wherein the solid particles having pozzolanic or hydraulic properties are based on ash.

4. A method according to claim 2, wherein the solid particles having pozzolanic or hydraulic properties are based on slag.

5. A method according to claim 2, wherein the solid particles having pozzolanic or hydraulic properties are of volcanic origin.

6. A method according to claim 1, wherein said additional means include a product of addition which is capable of setting.

7. A method according to claim 6, wherein said product of addition is lime.

8. A method according to claim 6, wherein said product of addition is cement.

9. A method according to claim 6, wherein said product of addition is calcium chloride.

10. A method according to claim 6, wherein the product of addition comprises a substance which, after having been employed, changes and acquires the properties of an adhesive.

11. A method according to claim 6, wherein the product of addition comprises a substance which, after having been employed, changes and acquires the properties of a binder.

12. A method according to claim 6, 7, 8, 9, 10 or 11, wherein the product of addition is employed in the form of a solution.

13. A method according to claim 6, 7, 8, 9, 10 or 11, wherein the product of addition is employed in the form of a suspension.

14. A method according to claim 6, 7, 8, 9, 10 or 11, wherein the product of addition is employed in the form of an emulsion.

15. A method according to any one of the claims 1 to 6, 10 and 11, wherein said material is placed in position by a hydraulic filling.

16. A method according to any one of the claims 1 to 6, 10 and 11, wherein the cladding of the facing wall means is obtained by horizontally juxtaposing and superimposing U-section elements having a concavity which faces inwardly of the structure and flanges which constitute reinforcements.

17. A method according to any one of the claims 1 to 6, 10 and 11, wherein the cladding of the wall is obtained by horizontally juxtaposing and superimposing U-section elements having a concavity which faces inwardly of the structure and flanges which constitute reinforcements and support further reinforcements.

18. A method according to any one of the claims 1 to 6, 10 and 11, wherein the reinforcements are formed by relatively flexible bands.

19. A method according to claim 16, wherein said flanges are wide flanges.

20. A method for working a mine by the bord-and-pillar method, comprising constructing, around a group of pillars, on a foot wall of a mine chamber, an enclosure having walls which define a closed contour, said walls being obtained by horizontal juxtaposition and superimposition of U-section elements whose concavity faces inwardly of the enclosure and whose flanges form reinforcements, and producing inside the enclosure a hydraulic fill comprising initially pulverulent non-coherent solid particles and additional means which, when mixed with said particles, produce a setting of said fill over a non-critical period of time, the fill frictionally engaging the reinforcements to initially consolidate the pillars and ultimately consolidating the pillars as a cohesive mass.

21. A method for working a mine by the bord-and-pillar method, comprising constructing, around a group of pillars, on a foot wall of a mine chamber, an enclosure having walls which define a closed contour, said walls being obtained by horizontal justaposition and superimposition of U-section elements whose concavity faces inwardly of the enclosure and whose flanges support reinforcements in the form of relatively flexible bands, and producing inside the enclosure a hydraulic fill comprising initially pulverulent non-coherent solid particles and additional means which, when mixed with said particles, produce a setting of said fill over a non-critical period of time, the fill frictionally engaging the reinforcements to initially consolidate the pillars and ultimately consolidating the pillars as a cohesive mass.

22. A method according to claim 20 or 21, wherein said contour is a rectangular contour.

23. A method for producing a structure which sets over a non-critical period of time, said method comprising in combination constructing an enclosure comprising a continuous wall of superimposed cladding elements which are integral with reinforcing means which extend from said cladding elements inwardly of said enclosure substantially in a plurality of substantially horizontal vertically spaced-apart planes, filling the space within said enclosure with a material comprising substantially non-coherent solid particles that frictionally contact said reinforcing means and initially constitute a stabilized structure owing to the action of said friction, said material including additional means mixed with said particles that causes said material to set, said noncriticality being due to the immediate stabilizing effect of said friction between said material and said reinforcing means.

* * * * *